US009626942B2

(12) United States Patent
Tanabe

(10) Patent No.: US 9,626,942 B2
(45) Date of Patent: Apr. 18, 2017

(54) FLUTE SUPPORT

(71) Applicant: Yuichi Tanabe, Red Hook, NY (US)

(72) Inventor: Yuichi Tanabe, Red Hook, NY (US)

( * ) Notice: Subject to any disclaimer, the term of this patent is extended or adjusted under 35 U.S.C. 154(b) by 119 days.

(21) Appl. No.: 14/332,957

(22) Filed: Jul. 16, 2014

(65) Prior Publication Data

US 2016/0019872 A1 Jan. 21, 2016

(51) Int. Cl.
*G10D 7/02* (2006.01)
*G10D 9/00* (2006.01)
*G10D 9/02* (2006.01)

(52) U.S. Cl.
CPC ..... *G10D 7/026* (2013.01); *G10D 7/02* (2013.01); *G10D 9/00* (2013.01); *G10D 9/02* (2013.01)

(58) Field of Classification Search
CPC G10D 7/02; G10D 7/026; G10D 9/00; G10D 9/02
USPC ..... 84/384, 380 R, 453
See application file for complete search history.

(56) References Cited

U.S. PATENT DOCUMENTS 2,803,983 A * 8/1957 Dowling ..... G10D 9/00 84/380 R
2,847,892 A * 8/1958 Laas ..... G10D 9/00 84/380 R
2,933,968 A * 4/1960 Hearne, Jr. ..... G10D 9/00 84/380 R
3,988,958 A * 11/1976 Brunkow ..... G10D 9/00 84/380 R
4,348,935 A * 9/1982 Bay ..... G10D 9/00 84/380 R
4,763,556 A * 8/1988 Peplowski ..... G10D 9/00 84/384
5,025,699 A * 6/1991 Toyama ..... G10D 9/00 84/380 C
D339,601 S * 9/1993 Diefes ..... 84/385 R
5,553,529 A * 9/1996 Smith ..... G10D 9/00 224/910
5,708,226 A * 1/1998 Nagahara ..... G10D 9/043 84/380 R
6,037,533 A * 3/2000 Runyon ..... G10D 7/08 84/380 R
6,759,584 B2 * 7/2004 Sundstrom ..... G10G 5/005 84/387 A
7,566,825 B2 * 7/2009 Ewell ..... G10D 7/063 84/380 A
8,269,086 B1 * 9/2012 Tanabe ..... G10D 9/00 84/322
2007/0044634 A1 * 3/2007 Bear ..... G10D 7/026 84/380 R
2007/0044635 A1 * 3/2007 Lee ..... G10D 9/00 84/384

* cited by examiner

*Primary Examiner* — David Warren
*Assistant Examiner* — Christina Schreiber
(74) *Attorney, Agent, or Firm* — Law Offices of Michael L. Wise, LLC

(57) ABSTRACT

An apparatus comprises a flute, a base, and a thumb rest. The base is attached to the flute and defines a channel. The thumb rest is inserted into the channel and defines an elongate body. The thumb rest is positioned such that a flutist may rest a right thumb against the thumb rest while using conventional fingering to play the flute.

18 Claims, 4 Drawing Sheets

FLUTE SUPPORT

FIELD OF THE INVENTION

The present invention relates generally to accessories for musical instruments, and, more particularly, to accessories for use while playing a flute.

BACKGROUND OF THE INVENTION

A Western concert flute is a side-blown flute, meaning that the player blows directly across the edge of a mouthpiece while the remainder of the flute's tubular body is held transverse to the player's body. The air stream across the mouthpiece creates a Bernoulli Effect that excites the air contained in the tubular body. The player changes the pitch of the sound by opening and closing holes in the body of the instrument, thus changing the effective length of a resonator and its corresponding resonant frequency. By varying the air pressure, a flute player can also change the pitch of a note by causing the air in the flute to resonate at a harmonic other than the fundamental frequency without opening or closing any holes.

While playing a flute, a player utilizes all the player's fingers except the right thumb to operate the keys of the instrument. For support, the flute rests on the root of the player's left index finger and on the player's right thumb. Unfortunately, this arrangement is not particularly stable. If the flute is not adequately supported, the pressure on the mouthpiece may cause the flute to rotate about its longitudinal axis. Likewise, that same pressure may try to twist the flute so that its distal end moves towards the player's body. Each of these effects may become more pronounced when the player's hands become sweaty due to, for example, the stress of a performance. Under extreme conditions, the flute may even slip away entirely and the player may lose the player's hand position.

An attempt to address the problem of adequately supporting a flute while playing that instrument can be found in U.S. Patent Publication No. 2007/0044635 (now abandoned) to Lee, entitled "Flute Attachment." This solution utilizes a "securing member" that is attached to the flute's body and against which a player may rest the player's right thumb when playing the instrument. Nevertheless, such a solution is configured to be "substantially C-shaped" and to attach to the flute by a clamping action. There is, as a result, strong concern that such an attachment will affect the resonant qualities of the flute and thereby change its sound. Such an attachment may also limit the freedom of movement of the flute player's thumb, which consequently restricts the hand position and makes it uncomfortable and more difficult to play the flute. Lastly, there is a concern that such a solution may actually damage the instrument. Accordingly, while such a solution may be effective in helping to stabilize the flute, it is far from ideal.

For the foregoing reasons, there is a need for alternative means of supporting a flute while playing that instrument. Ideally, such a solution will not substantially affect the sound of the flute, will not damage the flute, and will accommodate flute players with different sized hands.

SUMMARY OF THE INVENTION

Embodiments of the present invention address the above-identified needs by providing apparatus capable of helping to support a flute while that instrument is being played.

In accordance with an aspect of the invention, an apparatus comprises a flute, a base, and a thumb rest. The base is attached to the flute and defines a channel. The thumb rest is inserted into the channel and defines an elongate body. The thumb rest is positioned such that a flutist may rest a right thumb against the thumb rest while using conventional fingering to play the flute.

In accordance with an additional aspect of the invention, an apparatus to be used by a flutist while playing a flute comprises a base and a thumb rest. The base is adapted to be attached to the flute and defines a channel. The thumb rest defines an elongate body, and is adapted to be inserted into the channel and to be positioned such that the flutist may rest a right thumb against the thumb rest while using conventional fingering to play the flute.

In accordance with even another aspect of the invention, a method for playing a flute comprises attaching a base to the flute, the base defining a channel. A thumb rest is then inserted into the channel. The thumb rest defines an elongate body and is positioned such that the flutist may rest a right thumb against the thumb rest while using conventional fingering to play the flute.

Advantageously, the above-identified embodiments of the invention allow a flute player to more securely hold a flute while, at the same time, leaving the flute player's fingers free to operate the flute in a conventional manner and without an awkward hand position. The tendency of the flute to rotate about its longitudinal axis is strongly suppressed. Playing the instrument becomes easier, and concerns about losing finger position or even dropping the instrument are mitigated.

BRIEF DESCRIPTION OF THE DRAWINGS

These and other features, aspects, and advantages of the present invention will become better understood with regard to the following description, appended claims, and accompanying drawings where:

DETAILED DESCRIPTION OF THE INVENTION

The present invention will be described with reference to illustrative embodiments. For this reason, numerous modifications can be made to these embodiments and the results will still come within the scope of the invention. No limitations with respect to the specific embodiments described herein are intended or should be inferred.

In addition, it should be noted that the word "flute" as used herein is intended to incorporate any musical instrument wherein the musician blows directly across the edge of the instrument's mouthpiece in order to produce sound. As used herein, the term "flute" therefore includes, but is not limited to, a Western concert flute, a piccolo, a fife, a dizi, a bansuri, and a fue. Moreover, as used herein, the "longitudinal axis of the flute" is defined as an imaginary line that runs lengthwise through the center of the cylindrical body of the flute. Finally, the terms "manually translatable" and "manually bendable," as used herein, are intended to mean capable of being translated or bent, respectively, by a human of average strength utilizing only his hands.

Figure 1:
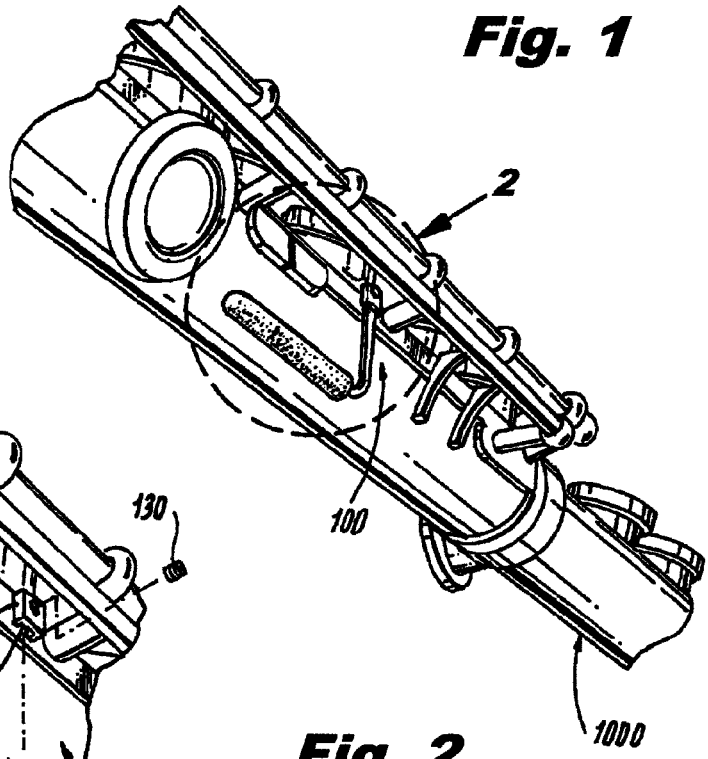
FIG. 1 shows a perspective view of an apparatus in accordance with a first illustrative embodiment of the invention attached to a flute.
Figure 2:
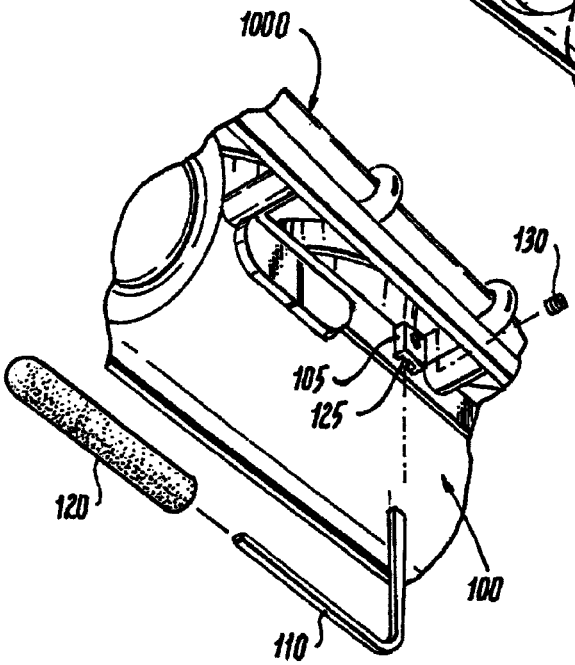
FIG. 2 shows an exploded perspective view of the FIG. 1 apparatus and flute.

FIGS. 1 and 2 show aspects of an apparatus 100 in accordance with a first illustrative embodiment of the invention in combination with a flute 1000. FIG. 1 shows a perspective view of the apparatus 100, while FIG. 2 shows another perspective view with the apparatus 100 exploded to reveal its constituent parts. The apparatus 100 comprises a base 105 that is attached to the flute 1000. A thumb rest 110 is inserted into the base 105 and defines an elongate body with a rectangular cross-section (i.e., a quadrilateral cross-section) and a ninety degree bend about half-way downs its length. A distal end of the thumb rest 110 runs substantially parallel with the longitudinal axis of the flute 1000 in a direction towards the mouthpiece of the flute 1000. The distal end of the thumb rest 110 is covered in a pad 120.

A proximal end of the thumb rest is inserted into a channel 125 that passes through the base 105 in a direction perpendicular to the longitudinal axis of the flute 1000. A screw 130 passes through a threaded hole in an exposed sidewall of the base 105, allowing the screw 130 to be tightened against the thumb rest 110. Tightening the screw 130 places a compressive force on the thumb rest 110 and inhibits it from moving relative to the base 105. Loosening the screw 130 allows the thumb rest 110 to be manually translated within the channel 125 in the base 105. The screw 130 thereby acts as a locking mechanism, wherein the thumb rest 110 is manually translatable within the base 105 when the locking mechanism is in a first state, and the thumb rest 110 is not manually translatable within the base 105 when the locking mechanism is in a second state.

Figure 3:
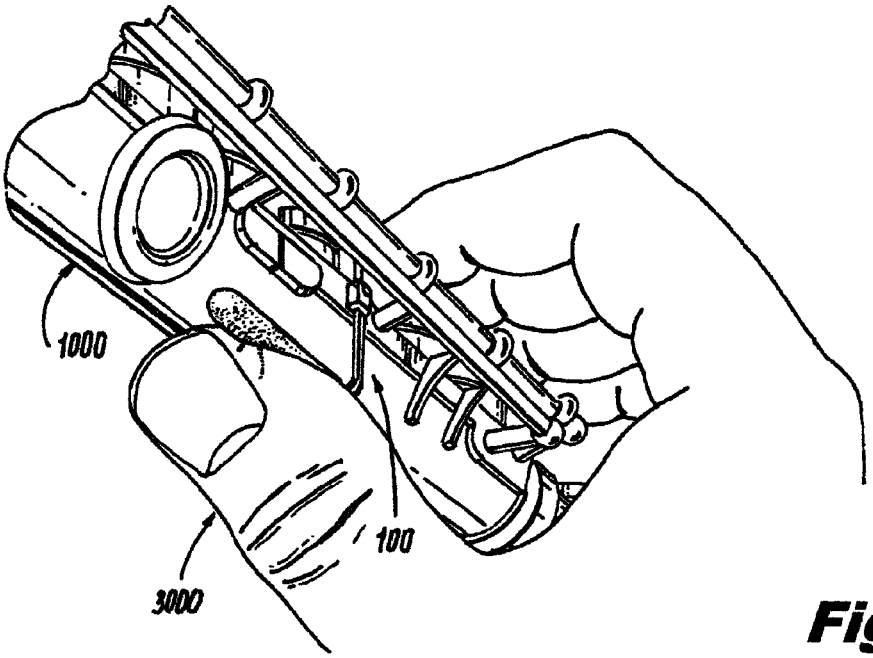
FIG. 3 shows a perspective view of the FIG. 1 apparatus and flute while the flute is being played.

In the present, non-limiting embodiment, the apparatus 100 is located below where a flutist's index finger falls when placing his right hand in what is often called the "home position" with respect to the flute 1000. So placed, the apparatus 100 is positioned such that the flutist may rest a right thumb against the thumb rest 110 while playing the flute 1000 using conventional fingering. Such a condition is shown in the perspective view in FIG. 3, which shows a right thumb 3000 of a flutist pressed against the thumb rest 110. Conventional fingering of the flute 1000 will be familiar to one having ordinary skill in the art, and is also described in several readily available publications including, for example, N. Toff, *The Flute Book: A Complete Guide for Students and Performers*, Oxford University Press, 2012, which is hereby incorporated by reference herein.

Positioned in this manner, the apparatus 100 in combination with the flutist's right thumb 3000 inhibit the flute 1000 from rotating about its longitudinal axis. At the same time, the flutist's right thumb 3000 continues to contact the flute 1000 in a natural manner without being "locked" into a given position or angle. That is, the flutist may translate his thumb 3000 and/or change its angle as desired while maintaining contact with the thumb rest 100 and the flute 1000. Playing the flute 1000 thereby becomes easier, and concerns about losing finger position are eased. Loosening and tightening the screw 130 in the base 105 allows the flutist to select a desired spacing between the thumb rest 110 and the flute 1000. The apparatus 100 may thereby be tailored to a particular user's hand size as well as preferences with respect to hand position.

Moreover, optionally, the thumb rest 110 may be formed from a somewhat pliable material such as, but not limited to, aluminum or steel. The thumb rest 110 may therefore be bent by the user to even further customize its orientation relative to the flute 3000. Stated another way, the thumb rest 110 may be manually bendable.

Figure 4:
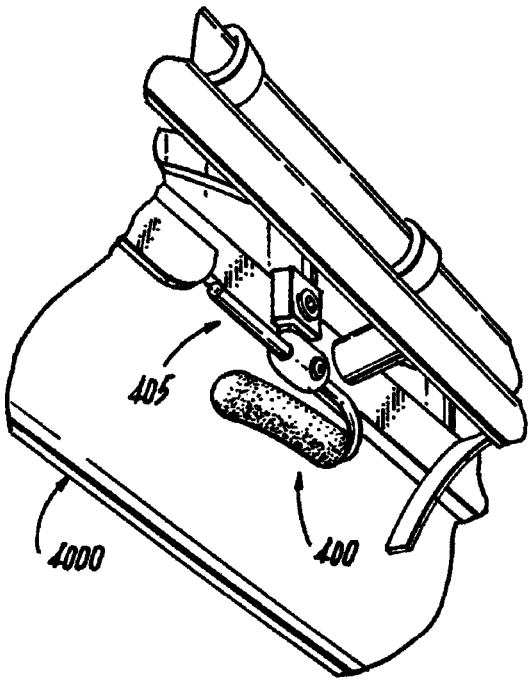
FIG. 4 shows a perspective view of an apparatus in accordance with a second illustrative embodiment of the invention attached to a flute.
Figure 5:
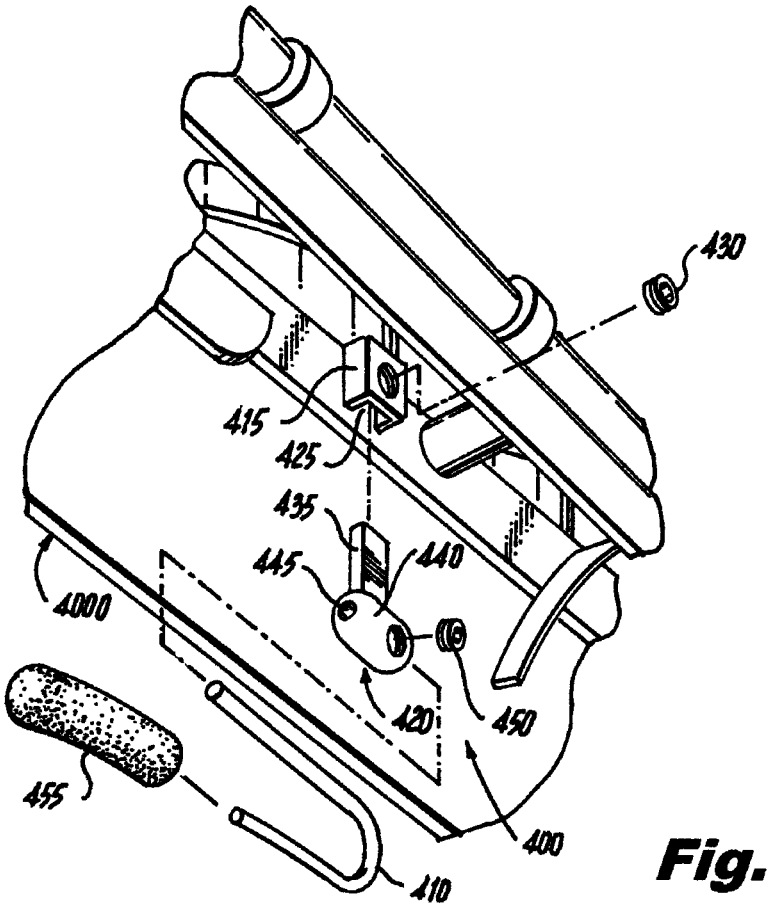
FIG. 5 shows an exploded perspective view of the FIG. 4 apparatus and flute.

FIG. 4 shows a perspective view of an apparatus 400 in accordance with a second illustrative embodiment of the invention attached to a flute 4000, while FIG. 5 shows an exploded perspective view of the same elements. Like the apparatus 100, the apparatus 400 comprises a base 405 and a thumb rest 410. However, instead of being a unitary element, the base 405 in the apparatus 400 comprises two separable portions: a flute attachment portion 415 and a thumb rest attachment portion 420.

The flute attachment portion 415 of the base 405 is similar to the base 105. It is attached to a flute 4000 and defines a first channel 425 that passes through the flute attachment portion 415 in a direction perpendicular to the longitudinal axis of the flute 4000. A first screw 430 passes through a threaded hole in an exposed sidewall of the flute attachment portion 415. The thumb rest attachment portion 420 of the base 405 defines a tab 435, which projects from a cylindrical body portion 440. The cylindrical body portion 440 has a second channel 445 passing therethrough, which runs substantially parallel to the longitudinal axis of the flute 4000. The tab 435 of the thumb rest attachment portion 420 is inserted into the first channel 425 of the flute attachment portion 415. The thumb rest attachment portion 420 may be adjustably fixated in position in the flute attachment portion 415 using the first screw 430 as a locking mechanism, as described above with respect to apparatus 100.

The thumb rest 410 defines an elongate, round, wire-like body with a 180-degree bend about half way down its length. A proximal end of the thumb rest 410 is inserted into the second channel 445 of the thumb rest attachment portion 420. A second screw 450 is threaded through the thumb rest attachment portion 420 and can be tightened against the thumb rest 410. The second screw 450 acts as a locking mechanism for the thumb rest 410 within the thumb rest attachment portion 420. Loosening the second screw 450 allows the thumb rest 410 to be translated along the flute's longitudinal axis as well as rotated inside the thumb rest attachment portion 420. Tightening the second screw 450 fixes the thumb rest 410 in the desired position and orientation. The apparatus 400 thereby provides two additional degrees of freedom for adjustability in comparison to the apparatus 100 (i.e., longitudinal translation and rotation). A distal end of the thumb rest 410 runs substantially parallel with the longitudinal axis of the flute 4000 and points towards the mouthpiece of the instrument. It is covered in a pad 455. This portion of the thumb rest 410 creates a support against which the flutist's right thumb may rest while playing the flute 4000 using conventional fingering.

Figure 6:
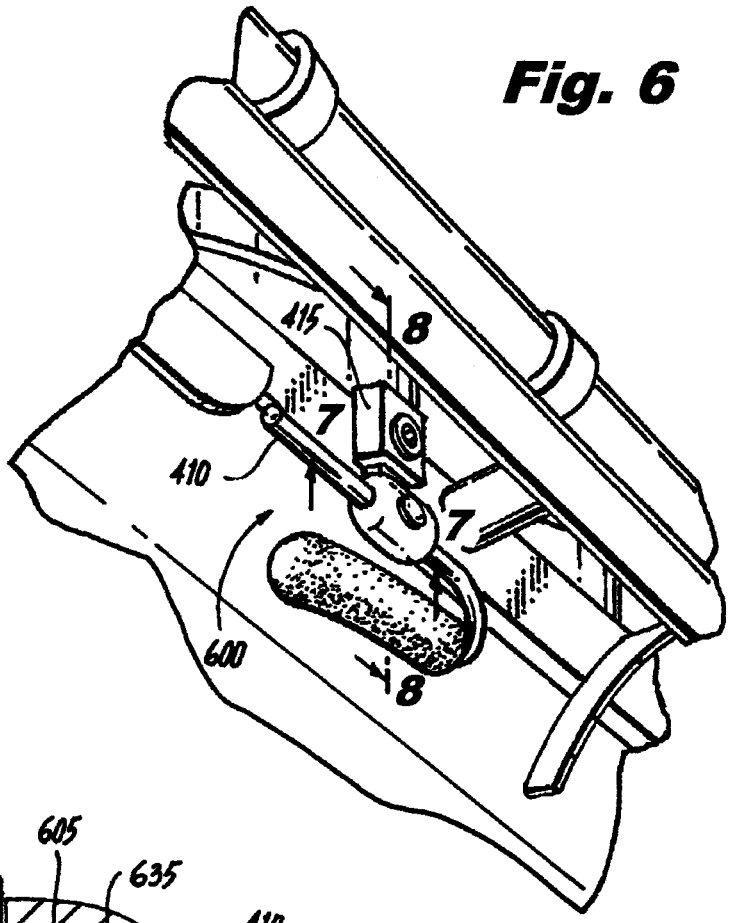
FIG. 6 shows a perspective view of an alternative thumb rest attachment portion for use in the FIG. 4 apparatus.
Figure 7:
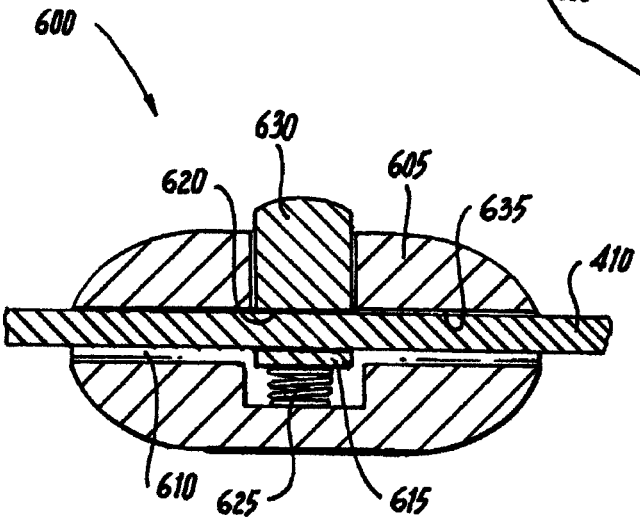
FIG. 7 shows a first sectional view of the FIG. 6 alternative thumb rest attachment portion.
Figure 8:
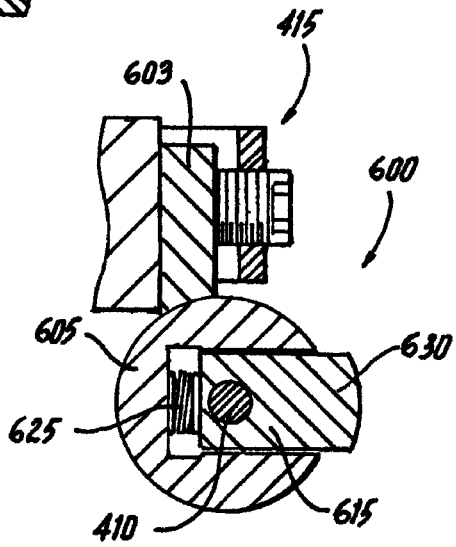
FIG. 8 shows a second sectional view of the FIG. 6 alternative thumb rest attachment portion.

While a set screw arrangement may be utilized to allow the position of the thumb rest 410 to be modified with respect to the thumb rest attachment portion 420 of the base 405, it will be recognized that several alternative locking mechanisms may be utilized and the results will come within the scope of the invention. FIGS. 6-8 show a perspective view and two sectional views, respectively, of an alternative thumb rest attachment portion 600 that may be used in place of the thumb rest attachment portion 420 in the apparatus 400. The thumb rest 410 and the flute attachment portion 415 are identical to those shown in FIGS. 4 and 5.

A tab 603 of the alternative thumb rest attachment portion 600 enters the flute attachment portion 415 and may be fixated therein. Moreover, the alternative thumb rest attachment portion 600 further comprises an outer body portion 605 defining an outer channel 610, and an inner lifting portion 615 defining an inner channel 620. The outer channel 610 has a diameter slightly larger than that of the inner channel 620. The inner lifting portion 615 is biased upward by a spring 625 and protrudes from the top of the thumb rest attachment portion 600 to define a button 630. In use, the thumb rest 410 passes through the outer channel 610 and the inner channel 620 (i.e., the inner lifting portion 615 encircles a portion of the thumb rest 410). When the button 630 is released (i.e., not pressed), the spring 625 causes the inner lifting portion 615 to raise the thumb rest 410 within the outer channel 610 and thereby press the thumb rest 410 against a sidewall 635 of the outer channel 610. This creates friction and inhibits the motion of the thumb rest 410 within the thumb rest attachment portion 600. In contrast, when the button 630 is slightly depressed, the inner lifting portion 615 pulls the thumb rest 410 so that it is more centered in the larger outer channel 610, and does not contact, or only lightly contacts, the sidewall 635 thereof. Friction is thereby reduced, allowing the thumb rest 410 to be manually translated inside the thumb rest attachment portion 600. When the desired position is achieved, the user merely releases the button 630 to fix the positioning.

Figure 9:
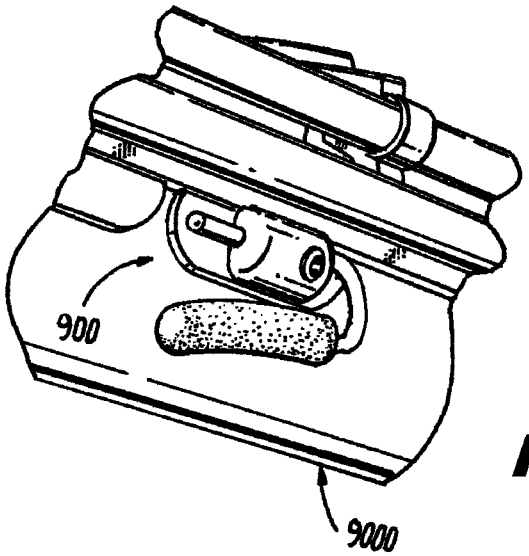
FIG. 9 shows a perspective view of an apparatus in accordance with a third illustrative embodiment of the invention attached to a flute.
Figure 10:
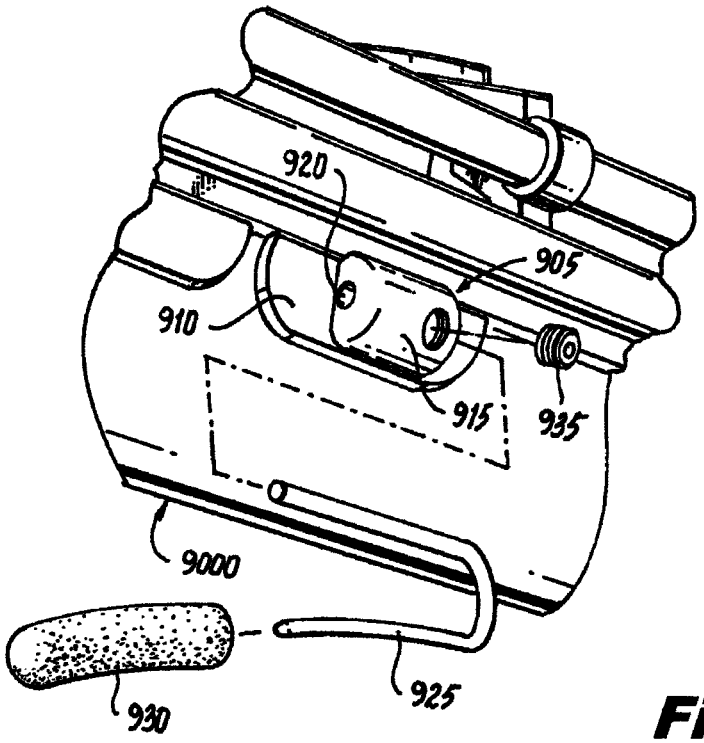
FIG. 10 shows an exploded perspective view of the FIG. 9 apparatus and flute.

Lastly FIGS. 9 and 10 show aspects of an apparatus 900 in accordance with a third illustrative embodiment of the invention in combination with a flute 9000, with FIG. 9 showing an intact perspective view, and FIG. 10 showing an exploded perspective view. A base 905 of the apparatus 900 comprises a substantially flat portion 910 from which projects a partially cylindrical portion 915. The partially cylindrical portion 915 defines a channel 920 that passes therethrough and is oriented along the longitudinal axis of the flute 9000.

A thumb rest 925 of the apparatus 900 is similar to the thumb rest 410 in the apparatus 400. That is, the thumb rest 925 defines a wire-like, elongate body with a 180-degree bend approximately half way down its length. A distal end of the thumb rest 925 runs substantially parallel with the longitudinal axis of the flute 9000. It is covered in a pad 930 to form a support against which the flutist's right thumb may rest while playing the flute 9000.

A proximal end of the thumb rest 925 passes through the channel 920 and is fixated in position using a screw 935. Loosening the screw 935 allows the thumb rest 925 to be translated along the flute's longitudinal axis as well as rotated inside the partially cylindrical portion 915. Tightening the screw 935 fixes the thumb rest 925 in place. Alternatively, the partially cylindrical portion 915 can include a button-operated locking mechanism similar to that described above with reference to FIGS. 6-8. In either case, the apparatus 900 offers the user two degrees of freedom for adjustability (i.e., longitudinal translation and rotation), allowing the user a wide degree of customization.

Once their unique structures and functions are understood from the teachings herein, the illustrative apparatus 100, 400, 900 may be formed from commercially available, off-the-shelf materials using conventional manufacturing techniques that will be familiar to a person having ordinary skill in the manufacturing arts. A span of quadrilateral or round metallic wire may, for example, form the skeletons of the thumb rests 110, 410, 925, while the elements forming the bases 105, 405, 905 may be formed from metal or plastic utilizing machining or molding. The bases 105, 405, 905 may be attached to a flute by several different methods including, but not limited to, welding, gluing, and fastening using a fastener such as a screw. To create the pads 120, 455, 930, the thumb rests 110, 410, 925 may be coated in epoxy, or, alternatively, may be covered by a softer material such as, for example, silicon rubber or leather.

In closing, it should again be emphasized that the above-described embodiments of the invention are intended to be illustrative only. Other embodiments can use different arrangements of elements for implementing the described functionality. These numerous alternative embodiments within the scope of the appended claims will be apparent to one skilled in the art.

Moreover, all the features disclosed herein may be replaced by alternative features serving the same, equivalent, or similar purposes, unless expressly stated otherwise. Thus, unless expressly stated otherwise, each feature disclosed is one example only of a generic series of equivalent or similar features.

What is claimed is:

1. An apparatus comprising:

a flute;

a flute attachment portion, the flute attachment portion attached to the flute and defining a first channel;

a thumb rest attachment portion, the thumb rest attachment portion inserted into the first channel and defining a second channel; and a thumb rest, the thumb rest inserted into the second channel, defining an elongate body, and positioned such that a flutist may rest a right thumb against the thumb rest while using conventional fingering to play the flute.

2. The apparatus of claim 1, wherein the flute attachment portion defines a square or rectangular tube.

3. The apparatus of claim 1, wherein the first channel is oriented perpendicular to a longitudinal axis of the flute.

4. The apparatus of claim 1, wherein the second channel is oriented parallel to a longitudinal axis of the flute.

5. The apparatus of claim 1, wherein the first channel has a quadrilateral cross-section.

6. The apparatus of claim 1, wherein the second channel has a round cross-section.

7. The apparatus of claim 1, wherein:

the thumb rest attachment portion comprises a locking mechanism;

the thumb rest is manually translatable within the thumb rest attachment portion when the locking mechanism is in a first state; and the thumb rest is not manually translatable within the thumb rest attachment portion when the locking mechanism is in a second state.

8. The apparatus of a claim 1, wherein:

the thumb rest attachment portion comprises a screw, the screw positioned so as to be tightenable against the thumb rest;

the thumb rest is manually translatable within the thumb rest attachment portion when the screw is not tightened against the thumb rest; and the thumb rest is not manually translatable within the thumb rest attachment portion when the screw is tightened against the thumb rest.

9. The apparatus of claim 1, wherein the flute attachment portion is welded to the flute.

10. The apparatus of claim 1, wherein the flute attachment portion is attached to the flute by an adhesive.

11. The apparatus of claim 1, wherein a portion of the thumb rest has a quadrilateral cross-section.

12. The apparatus of claim 1, wherein a portion of the thumb rest has a round cross-section.

13. The apparatus of claim 1, wherein the thumb rest comprises a pad.

14. The apparatus of claim 1, wherein a portion of the thumb rest runs substantially parallel to a longitudinal axis of the flute.

15. The apparatus of claim 1, wherein the thumb rest is manually bendable.

16. An apparatus comprising:

a flute;

a base, the base attached to the flute and defining a channel; and a thumb rest, the thumb rest inserted into the channel, defining an elongate body, and positioned such that a flutist may rest a right thumb against the thumb rest while using conventional fingering to play the flute;

wherein the base comprises:

a lifting portion, the lifting portion encircling a portion of the thumb rest; and a spring, the spring biasing the lifting portion so as to press a portion of the thumb rest against a sidewall of the channel.

17. An apparatus for use by a flutist while playing a flute, the apparatus comprising:

a flute attachment portion, the flute attachment portion configured to be attached to the flute and defining a first channel;

a thumb rest attachment portion, the thumb rest attachment portion configured to be inserted into the first channel and defining a second channel; and a thumb rest, the thumb rest defining an elongate body, and configured to be inserted into the second channel and to be positioned such that the flutist may rest a right thumb against the thumb rest while using conventional fingering to play the flute.

18. A method to be used by a flutist in playing a flute, the method comprising the steps of:

attaching a flute attachment portion to the flute, the flute attachment portion defining a first channel;

inserting a thumb rest attachment portion into the first channel, the thumb rest attachment portion defining a second channel; and inserting a thumb rest into the second channel, the thumb rest defining an elongate body and positioned such that the flutist may rest a right thumb against the thumb rest while using conventional fingering to play the flute.

* * * * *